United States Patent [19]

Sedlmayer et al.

[11] 4,070,868

[45] Jan. 31, 1978

[54] OFF-SHORE DRILLING PLATFORM AND METHOD OF MOUNTING

[75] Inventors: Franz Sedlmayer; Paul Baron; Klaus Seifert, all of Wilhelmshaven, Germany

[73] Assignee: Fried. Krupp Gesellschaft mit beschrankter Haftung, Essen, Germany

[21] Appl. No.: 728,200

[22] Filed: Sept. 30, 1976

[30] Foreign Application Priority Data

Oct. 25, 1975 Germany ..... 2547890

[51] Int. Cl.[2] ..... E02B 17/00

[52] U.S. Cl. ..... 61/91; 254/105

[58] Field of Search ..... 61/91, 92, 65, 90; 114/264, 265; 254/106, 107, 105

[56] References Cited

U.S. PATENT DOCUMENTS

| | | | |
|---|---|---|---|
| 2,833,118 | 5/1958 | Nixon | 61/91 |
| 3,522,931 | 8/1970 | Von Heidenstam | 254/105 X |
| 3,876,181 | 4/1975 | Lucas | 61/91 X |

FOREIGN PATENT DOCUMENTS

| | | | |
|---|---|---|---|
| 991,247 | 5/1965 | United Kingdom | 61/90 |

*Primary Examiner*—Jacob Shapiro
*Attorney, Agent, or Firm*—Walter Becker

[57] ABSTRACT

An off-shore drilling platform structure and method of mounting in which the structure comprises a base with spaced upstanding legs thereon and a floatable platform slidable along the legs. Laminated tension elements have the opposite ends connected to the base and the upper ends of the legs and the platform has clamp devices for clampingly engaging the laminated tension elements. One clamp device pertaining to each element is nonmovable in the direction of the legs on the platform while the other is movable on the platform in the direction of the length of the legs by power operated devices. The clamp devices pertaining to each tension element are selectively operable so the platform can be moved along the legs.

6 Claims, 8 Drawing Figures

OFF-SHORE DRILLING PLATFORM AND METHOD OF MOUNTING

Off-shore drilling platforms have become known which in particular are employed for drilling crude oil in sea beds. Such off-shore drilling platforms comprise a base body with high upwardly extending legs and a floatable platform which has guiding holes for the legs. The base body which consists of concrete contains hollow chambers which, depending on the extent to which they are filled with water, give the base body buoyancy. For mounting the off-shore drilling platform, these parts are floated to the place of employment. The base body is fixedly connected to the platform below the latter, and the legs project upwardly upon the platform. At the site of employment, the hollow chambers of the base body are flooded. During the sinking or movement of the base body, a positive connection between the base body and the floating body is maintained in order to avoid damage due to high waves. To this end, cables are tensioned between the upper ends of the legs and the base body, which cables are uniformly distributed over the circumference of each leg and which cooperate with hoisting supports on the platform. In this connection, it has been suggested that one row of cables each is alternately fastened to an upper and a lower clamping device. The upper clamping device is firmly seated on an upper structure of the platform, whereas the lower clamping device can by hydraulic power operable devices be lifted and lowered relative to said upper structure. When the upper clamping devices are disconnected from the cables and the lower clamping devices are clamped to the cables, the outward movement of the piston rods of the power operable devices in downward direction will cause the base body to be lowered by a corresponding distance. Thereupon, the upper clamping devices are firmly connected to the cables, and the lower clamping devices are detached therefrom and are pulled upwardly by said power operable devices whereupon the cycle is repeated. In a corresponding manner, after the base body has been deposited on the sea bed, the platform is in a corresponding manner along said legs lifted above the sea level.

However, there exists the possibility that the clamping connection between the clamping device and the cables causes difficulties because it cannot clearly be protected, which adhering forces will be reached between the cables and the clamping jaws because the load distribution in the interior of the cables consisting of numerous strands, is uncertain. Thus, it may happen that the outer wires adhere to the clamping jaws, whereas the inner wires or some of them slip relative to the outer wires, which effect may be aided by the customary lubrication within the interior of the cables. Furthermore, there exists the danger that the cables, in view of strong compression are damaged by the clamping devices. The cables must consist of high-grade steel and are correspondingly expensive. Accordingly, it is an object of the present invention in conformity with which as tensioned pull members lamellae are employed instead of the above mentioned cables, for mounting off-shore drilling platforms according to the above mentioned principle, so to design the means for the positive connection between the base body and the platform during the lowering of the base body and the lifting of the platform that at relatively low cost a clearly calculable power distribution and thereby a maximum reliability will be assured.

These and other objects and advantages of the invention will appear more clearly from the following specification in connection with the accompanying drawings, in which:

FIGS. 1, 3 and 4 diagrammatically and respectively illustrate in side view an off-shore drilling platform in three different mounting stages.

Figure 7:
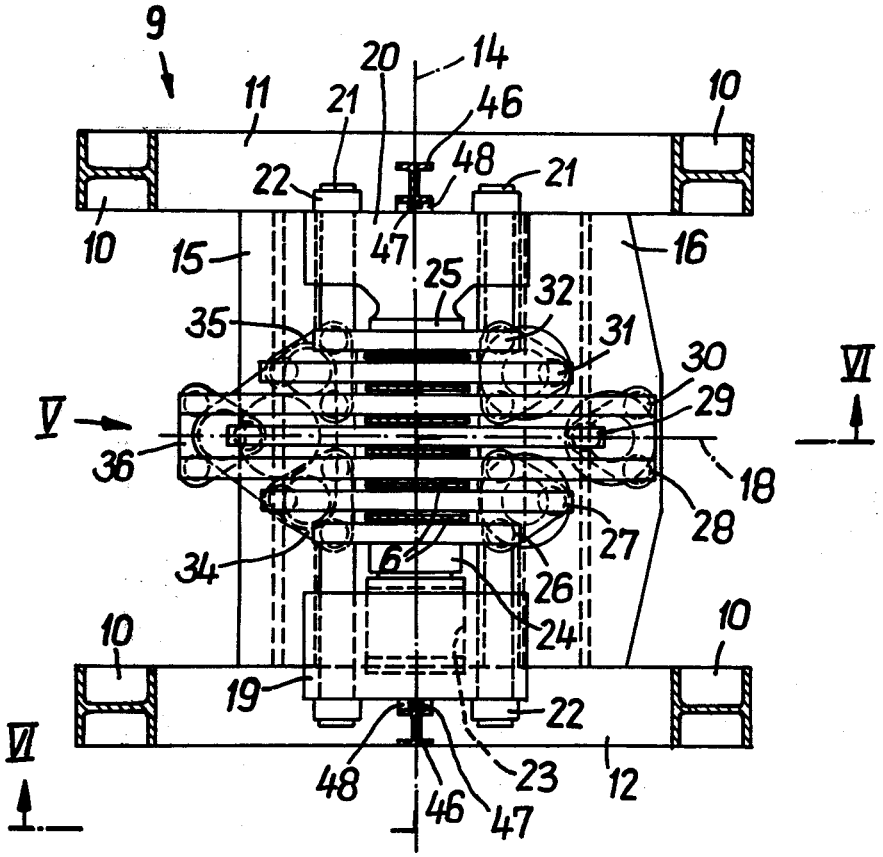
FIG. 7 represents a section taken along the line VII—VII of FIG. 6.
Figure 8:
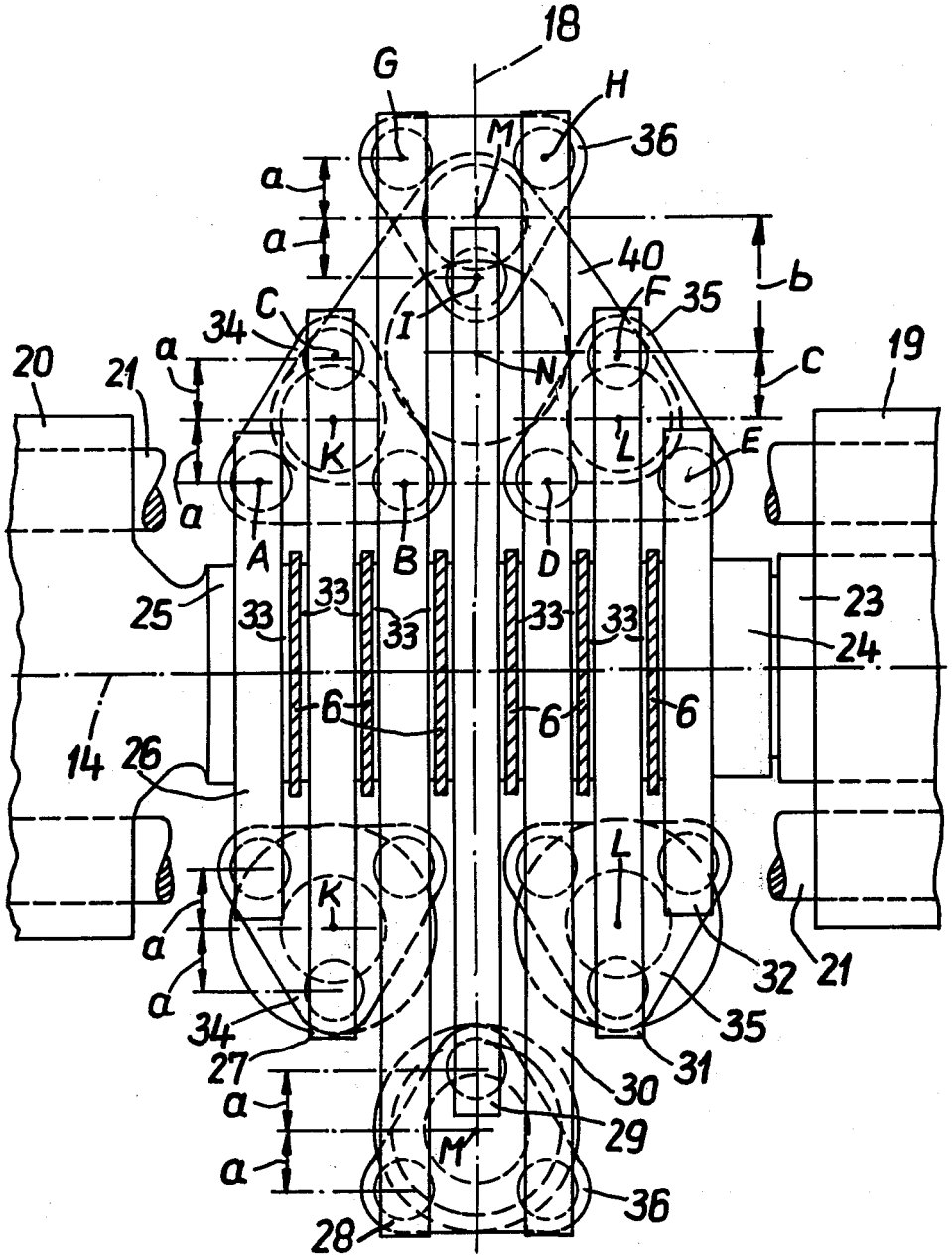

FIG. 8 shows a portion of FIG. 7 on a larger scale the off-shore drilling platform according to the present invention which comprises a base body with upwardly extending legs and a floatable platform slidably guided on said legs while pull members are provided between the upper ends of the legs and the base body in tensioned condition and while furthermore two clamping devices are provided which for movement of the base body and the platform in vertical direction relative to each other are alternately clamped to the pull members while one clamping device is continuously in vertical condition non-yieldably connected to the platform and the other clamping device is vertically moved in steps relative to said platform is characterized primarily in that the pull members are formed by lamellae.

Figure 1:
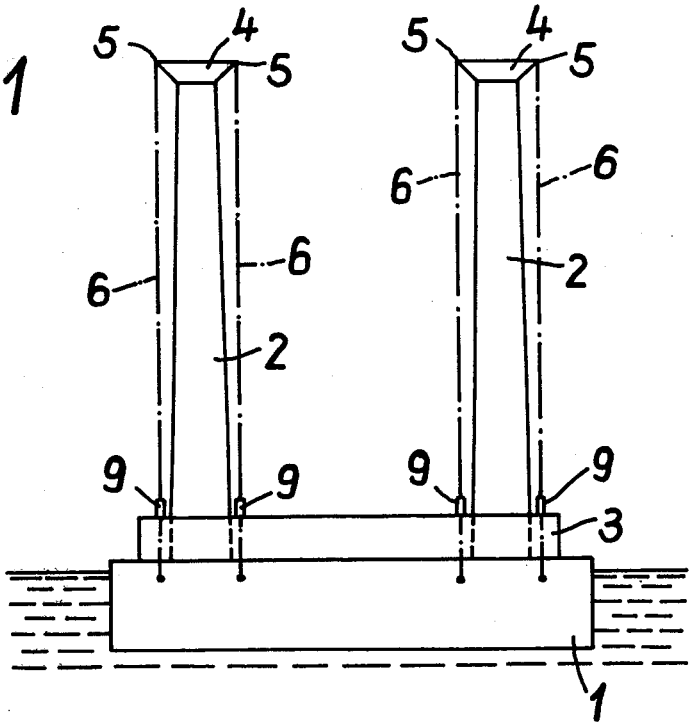
Figure 3:
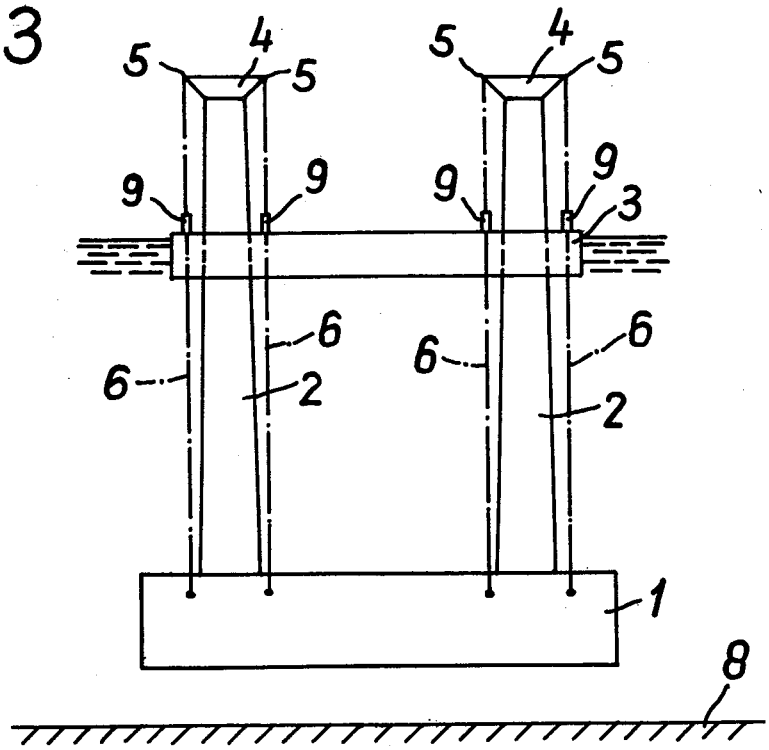
Figure 5:
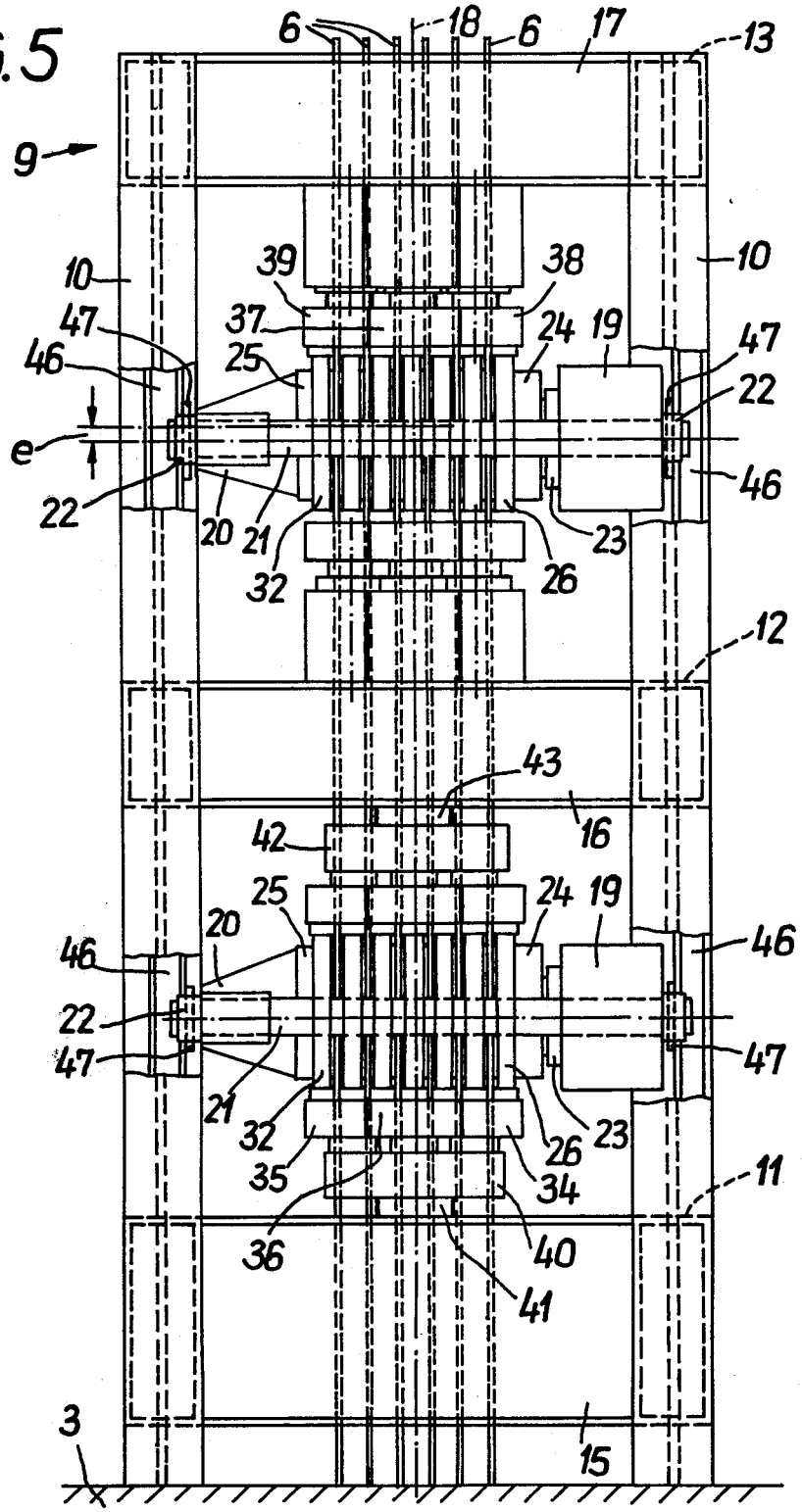
FIG. 5 shows an upper structure on the platform with a bundle of lamellae in side view (as seen in the direction of the arrow V in FIGS. 6 and 7).

Referring now to the drawings in detail, the off-shore drilling platform comprises a base body 1 with four upwardly extending legs 2 and furthermore comprises a platform 3. The base body 1 consists primarily of concrete and comprises hollow chambers which are adapted more or less to be filled with water and to be pumped empty. The legs 2 which consist primarily of pre-stressed concrete have the shape of slightly tapering truncated cones. Plates 4 which project all the way around are mounted on the upper ends of said legs 2. At the rim area of each plate at eight points 5 there are connected the same number of bundles of lamellae 6 as indicated in FIGS. 1, 3 and 5 by dot-dash lines. The lamellae 6 are from points 5 guided vertically downwardly and are anchored in the base body 1. By non-illustrated clamping means, the lamellae 6 are preloaded.

The platform 3 consists primarily of steel and is floatable. Similar to the base body 2, the platform 3 has a square-shaped form and near the square corners has openings extending therethrough through which openings the legs 2 extend. The openings are provided with guiding means not illustrated in the drawing which can be adapted to different diameters of the legs and convey horizontal forces between the base body 1 and the legs 2. The lamellae 6 are pressed with play through openings 7 (FIG. 6) of the platform 3.

Figure 4:
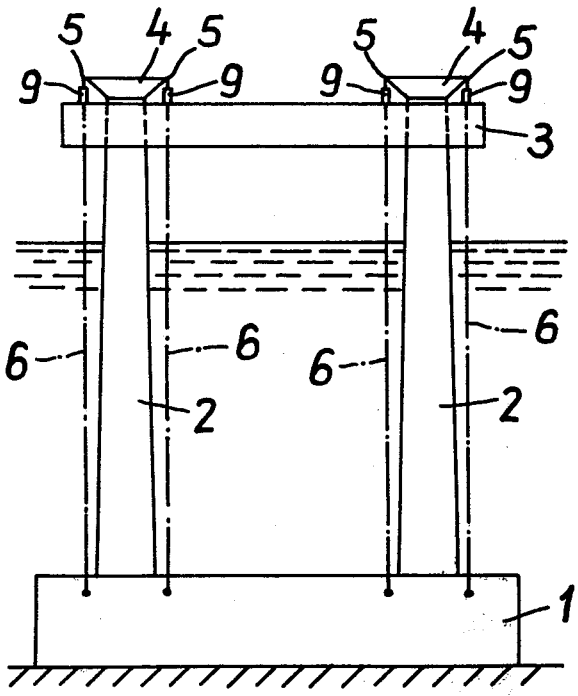
Figure 2:
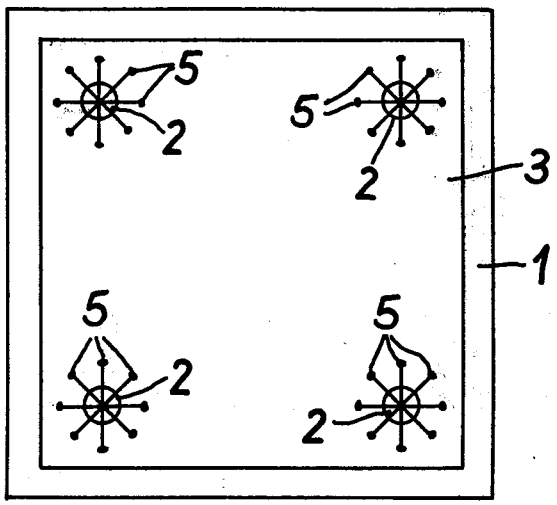
FIG. 2 is a top view of FIG. 1.

FIG. 1 shows the off-shore drilling platform in the condition in which it can floatingly be moved by vehicles to the place of use. The hollow chambers of said base body 1 are at least nearly pumped empty so that the base body 1 will float. The platform 3 rests on said base body 1, and both parts are firmly connected to each other. At the place of use, in conformity with FIG. 3, the base body 1 is lowered from the floating platform 3 until it rests on the sea bed 8. Thereupon the platform 3 is lifted at the legs 2 to the position shown in FIG. 4 in which the platform 3 is located at a distance above the sea level. The lowering of the base body and the lifting of the platform are effected by means of the devices which will now be described.

Firmly connected to the platform 3 and mounted thereon are upper structures 9 which are arranged around each leg 2 in such a way that a bundle 6 is centrally passed through each upper structure 9.

Each upper structure 9 comprises two frames each of which is formed by two posts 10 and a lower, an intermediate, and an upper latch 11, 12, 13 respectively. The two frames are rigidly interconnected by transverse beams which are located between two latches each and are arranged symmetrically to the vertical transverse central plane 4 of the upper structure while being spaced from each other. Between the two lower latches 11 there are provided two I-beams 15. The two intermediate latches 12 are interconnected by box beams 16 (Kastentrager), whereas box beams 17 are arranged the upper latches 13. A bundle of six lamellae 6 centrally extends through the chamber between the beams 15, 16, 17 and the latches 11, 12, 13 in such a way that their surfaces are located at a right angle to the vertical transverse central plane 14 which means parallel to the vertical longitudinal central plane 18 of the upper structure 9. The lamellae 6 consist of band steel of ordinary quality.

Two clamping devices are arranged at levels approximately centrally between the transverse beams 16 and 15 and approximately centrally between the transverse beams 17 and 16 and are provided with two clamping devices. Each of these devices consists of two yokes 19, 20 and of two pull members in the form of bolts 21 which are arranged horizontally and symmetrically with regard to the vertical transverse central plane 14. These pull members 2 extend through bores of the yokes 19, 20 and have both of their ends provided with heads 22 which engage the outer surfaces of said yokes. The bolts 21 are spaced from each other by such a distance that the lamellae 6 can be placed therebetween with play.

In the pot-shaped yoke 19 there is arranged the cylinder 23 of a hydraulic power operable device the piston of which engages a plate 24. Between this plate and a plate 25 firmly connected to the yoke 20 there are provided 7 rectangular discs 26–32 of identical height with surfaces which extend parallel to the vertical longitudinal central plane 18. The arrangement is such that the lamellae 6 extend between said surfaces. The discs 26–32 have that side thereof which faces said lamellae provided with rectangular elevations 33 (FIG. 8) which engage said lamellae nearly over the width thereof, while the height of said elevation 33 does not quite equal the height of said discs. The discs 26–32 have bores through which bolts 21 have been passed. In this way the discs are displaceable along said bolts. The discs have stepped lengths. The two outer discs 26 and 32 are the shortest. The next following discs 27, 31 are somewhat longer, and the longest discs are the discs 28 and 30, whereas the intermediate disc 29 is shorter than 28 and 30 but longer than discs 27, 31. The lower clamping device is at the bottom supported by the beams 15 and at the top relative to the beam 16 so that it will continuously retain its elevational location. The support for the beams 15 is effected by means of discs 26–32 through the intervention of two groups of equalizing plates which are arranged symmetrically with regard to the two vertical planes 17, 18. On each side of the lower clamping device, above and below the ends of the discs, there are provided two groups each of three smaller triangular plates 34, 35, 36 and 37, 38, 39 respectively. These plates have three supporting means which form supporting surfaces for the discs. The center points of the supporting surfaces are designated with the letters A, B, C, for instance for the plate 34, with the letters D, E, F, for plate 35, and with G, H, I, for the plate 36. These center points from isosceles triangles for each of the plates. The apices C, F, I, are located in the vertical planes of symmetry of the plates 34, 35 and 36 respectively. These planes form the vertical longitudinal central planes of discs 27, 29 and 31 respectively. The bases of the isosceles triangles are for instance for the plates 34, 35, 36 formed by the points A and B; D and E; and G and H, respectively. These plates are parallel to the vertical transverse central plane 14.

Each of the three plates of a group, for instance the plates 34, 35, 36 rests in points K, L and M on a larger triangular plate 40. The supporting points K, L and M are located in the vertical planes of symmetry of plates 34, 35 and 36 respectively so that they have the same distance *a* from the apices C, F, I, respectively and from the bases A-B, D-E, and G-H, respectively. The discs rest on the three plates of each group, for instance 34, 35, 36 in such a way that at the apices C, F, I, respectively there will act twice as high supporting forces as at the remaining supporting points, A, B, D, E, G, H. For instance, half of the frictional force designated with the chacter S attacks at the supporting point A. This force is then conveyed from one lamellae 6 onto the disc 26. Two lamellae 6 will act upon the next disc 27. Accordingly, the force S attacks at the point C of the support on which one end of disc 27 rests. The force S equals half the total force derived from the two lamellae, in other words, is twice as high as the force at point A. Two lamellae with the total force of 2S act upon the disc 28. Inasmuch as the long disc 28 with each end rests on two supports of discs 34 and 36, it will be appreciated that in each of the respective points B and G there acts one quarter of the total lamellae force acting upon the disc 28, which means that at each point B, G, the force is $\frac{1}{2}$S. Similarly, two lamellae act upon the intermediate disc 29 so that each end of disc 29 rests on the respective support in the center of the respective group of plates, for instance on plate 36 at the apex I with the force S. Corresponding remarks set forth for the above mentioned supporting points also apply to the supporting points D, E, F, and H. Consequently, the boom force acting upon each plate 34, 35, 36 balance each other with regard to the supporting points of the respective plate. More specifically, for instance upon plate 34 there acts on one hand a moment composed of the supporting force S attacking at point C, and the lever arm *a*, and on the other hand the moment of the same magnitude which moment is composed of the two supporting forces $\frac{1}{2}$S attacking at the points A and B and with the lever arm *a* with regard to the supporting point K.

The greater plate 40 on each side of the lower clamping device rests upon one of the I-beams 15 through a support 41. The center point of the supporting surface is in FIG. 8 designated with the letter N. This center point is located in the vertical plane of symmetry of plate 40 which means in the vertical longitudinal central plane 18, and more specifically in such a way that its distance *b* from supporting point M of plate 36 (measured in horizontal direction) equals its distance *c* measured in horizontal direction from the line passing through the supporting points K and L. Accordingly, the moments balance which act upon plate 40 of the supporting forces of plates 34, 35, 36. It will be appreciated that in the supporting points K and L there act supporting forces twice namely 2S with the lever arm *c*, whereas in the supporting point M there acts only once the supporting force S with the double lever arm *b*. The plate corresponding to disc 40 by means of which the upper plates 37, 38, 39 rest against the respective beam 16 is desiganted with the reference numeral 42, whereas the pertaining support or supporting bearing is designated with the reference numeral 43. The same designations are employed for the corresponding parts of the lower clamping device on the other side of planes 14. The supports 41, 43 may be designed as one-point bearings with ball calottes in order to obtain unequivocal supporting conditions. A taut clamping of the lower clamping device between the beams 15, 16 can be realized by the insertion of inserts at the supporting surfaces.

The upper clamping device rests in upward and downward direction against the beams 16, 17 through the intervention of hydraulic power operable devices. Between these devices and the discs 26–32 there are employed triangular balancing plates of the same design and arrangement as with the lower clamping devices. These plates of the upper clamping device are therefore designated with the same reference numerals 34–36 and 37–39. Each of these plates rests against the piston 44 of one of the hydraulic power operable devices, the cylinders 45 of which engage the beam 16, 17 respectively in such an arrangement that their central lines pass through the points K, M, and L respectively of plates 34–36 and 37–39 respectively. The cylinders of the two groups arranged on both sides of the above clamping device are hydraulically parallelly connected to the source of pressure fluid in such a way that in each of the cylinders there will always prevail the same liquid pressure. Corresponding remarks apply to the hydraulic power operable devices arranged below the upper clamping device. In this way, above and below the clamping device there will be realized a hydraulic power equalization.

The two clamping devices are for alignment relative to the upper structure 9 in horizontal direction guided along the two beams 46 each which in vertical arrangement between the lower latches 11 and the intermediate latches 12 as well as between these and the upper latches 30 are centrally arranged between the posts 10. Straps 47 mounted on the supports 46 in vertical arrangement engage guiding members 48 which are mounted on the yokes 19 and 20 on the outsides thereof.

When the base body 1 according to FIG. 3 is to be lowered by steps relative to the floating platform 3, the procedure is as follows.

Figure 6:
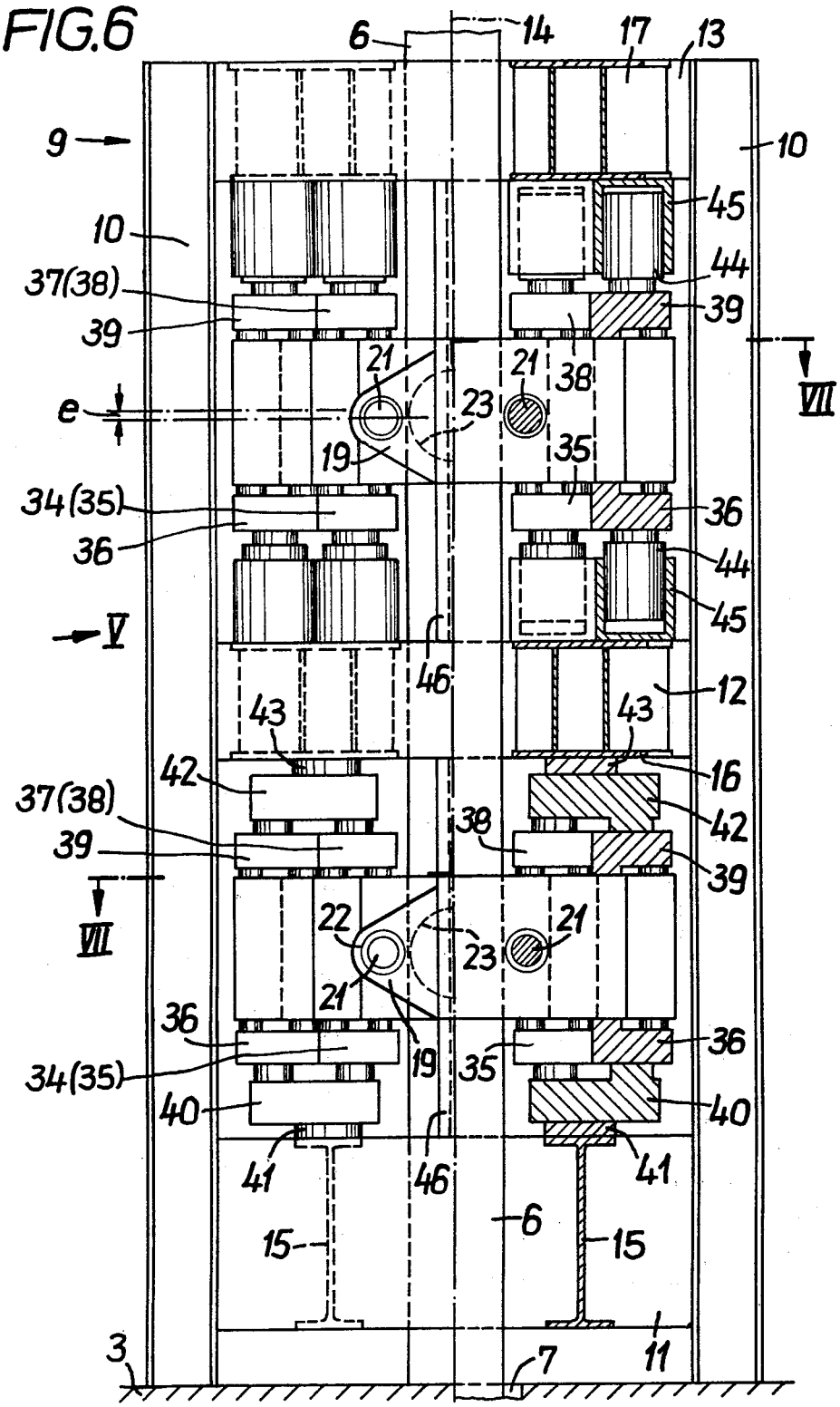
FIG. 6 shows the construction of the platform and more specifically half of it in view and half of it in a vertical central section along the line VI—VI of FIG. 7.

The upper clamping devices of all upper structures 9 are assumed to occupy their upper end portions in which the pistons 44 of the upper cylinders 45 have been moved inwardly and the lower pistons have been moved out of their cylinders. These positions are shown in FIGS. 5 and 6. It should be noted in this connection that the lower clamping devices are relieved and the upper clamping devices are actuated so that the discs 26–32 thereof are by a clamping effect firmly connected to the lamellae 6. Now the hydraulic power operabledevices are so actuated that the pistons are from the upper cylinders moved outwardly in downward direction while simultaneously the pistons of the lower cylinders are moved into the latter. In this way, the lamellae 6 are relative to the floating platform pulled downward so that the legs 2 with the base body 1 are moved downwardly by the stroke of the pistons. Thereupon, the lower clamping devices are applied, and the upper clamping devices are relieved. By actuation of the hydraulic power operable devices 44, 45, the upper clamping devices move upwardly by the stroke of the pistons. Thereupon, the upper clamping devices are applied, and the cycle is repeated. The same procedure applies when the platform 3 is to be lifted to the position shown in FIG. 4, relative to the base body 1 resting on the sea bed.

According to the above mentioned particular method of the invention, the clamping devices for all four legs are not actuated simultaneously. For instance, the actuation of the clamping devices of the power operable devices for lifting and lowering may be effected only with one of the four legs so that the four corners of the base body 1 will not simultaneously but only successively be lowered by the piston stroke. It is also possible that the lowering is each time effected on two of the legs arranged on a square side.

As will be seen from FIGS. 5 and 6, with each clamping device, the line of efficiency of the power operable device 23 serving for applying the clamping device is located by the distance *e* lower than the central line through the centers of gravity of the surfaces in which the elevations 33 of discs 26–32 engage the lamellae 6. In this way, up to a certain degree, a balancing between the forces will be realized by which forces the lamellae are subjected to stress. It will be appreciated that the pulling force acting in the lamellae decreases from the effective line of the power operable device in upward direction. Accordingly, a correspondingly reduced pressing force is superimposed upon the maximum pull stresses at the lamellae at the upper rim portion of the elevations 33, whereas at the bottom where the pressing force is highest, the pull force is considerably lower than at the top. Consequently, the lamellae are taken advantage of for effecting an optimum power transmission.

It is, of course, to be understood that the present invention is, by no means, limited to the specific showing in the drawings, but also comprises any modifications within the scope of the appended claims.

What is claimed is:

1. In an off-shore drilling platform structure; a base body, legs connected to and upstanding from the base body, a floatable platform slidable on said legs, flexible tension elements extending between the upper ends of said legs and said base body, at least two clamp devices on said platform engageable with at least one of said tension elements, means for selectively clamping said tension element to each said clamp device or for releasing the tension element from each clamp device, means for moving at least one clamp device on said platform in the direction of the length of said tension elements, said tension elements being formed of lamellae, each clamp device comprising a pair of counterbearings on opposite sides of the respective tension element, pull rods extending between said counterbearings, members slidable on said rods and disposed between the laminations of the respective tension element, and means for urging said counterbearings toward each other to clamp said clamp device to said tension element.

2. An off-shore drilling platform structure according to claim 3 which includes support elements engaging said members from above and beneath, each clamp device comprising frame means, and tiltable equalizing levers interposed between said support elements on said frame means.

3. An off-shore drilling platform structure according to claim 4 in which said equalizing levers comprise plate elements in the form of isoceles triangles with each plate element being loaded in the center and supported near the apices, each plate element when viewed in the direction of the length of said tension elements having a plane of symmetry parallel to the laminations of said tension elements.

4. An off-shore drilling platform structure according to claim 5 in which each plate element is in the form of an equilateral triangle and at least one equalizing lever has further equalizing levers supported thereon near the apices of said one lever.

5. An off-shore drilling platform structure according to claim 4 in which at least one of said clamp devices includes fluid operable motor means interposed between said equalizing levers and said frame means.

6. An off-shore drilling platform structure according to claim 3 in which clamp device has a rod on each side of the respective tension element and the plane of the rods of each clamp device is below the level at which the clamping force exerted on the laminations of the tension elements can be considered to be concentrated.

* * * * *